United States Patent [19]

Bastian et al.

[11] Patent Number: 4,819,569

[45] Date of Patent: Apr. 11, 1989

[54] MOVABLE TABLE WITH STABILIZING APPARATUS

[75] Inventors: John M. Bastian, Manitowoc; David C. Pflieger, Two Rivers; Robert F. Seitz, Manitowoc, all of Wis.

[73] Assignee: Hamilton Industries, Inc., Two Rivers, Wis.

[21] Appl. No.: 158,204

[22] Filed: Feb. 19, 1988

[51] Int. Cl.[4] ..... A47B 3/00

[52] U.S. Cl. ..... 108/113; 16/18 B; 280/47.2

[58] Field of Search ..... 108/112, 113, 114; 16/32, 33, 34, 18 B; 280/47.2

[56] References Cited

U.S. PATENT DOCUMENTS

| | | | |
|---|---|---|---|
| 1,080,578 | 12/1913 | Peppe | 280/47.2 |
| 1,217,047 | 2/1917 | Morris | 280/47.2 |
| 3,432,878 | 3/1969 | Hupfer | 16/32 |
| 4,133,271 | 1/1979 | Carlson | 108/113 |
| 4,205,937 | 6/1980 | Fawley | 280/47.2 |
| 4,467,496 | 8/1984 | Gregg | 16/18 B |
| 4,596,196 | 6/1986 | Gunter et al. | 108/113 |

*Primary Examiner*—Peter A. Aschenbrenner
*Attorney, Agent, or Firm*—Tilton, Fallon, Lungmus & Chestnut

[57] ABSTRACT

A movable table is provided which includes a table top; two bench seats; a leg support assembly pivotally connected to the table top and the bench seats; four primary casters disposed below the leg support assembly and mounted to the assembly; and four auxiliary casters. The leg support assembly supports the table top and bench seats in an open and in a closed configuration; and it allows a user to place the table in these two positions. The auxiliary casters stabilize the table in the closed position when it begins to tip over. In addition, these auxiliary casters allow the primary casters to easily skip over obstacles.

5 Claims, 2 Drawing Sheets

FIG. 1
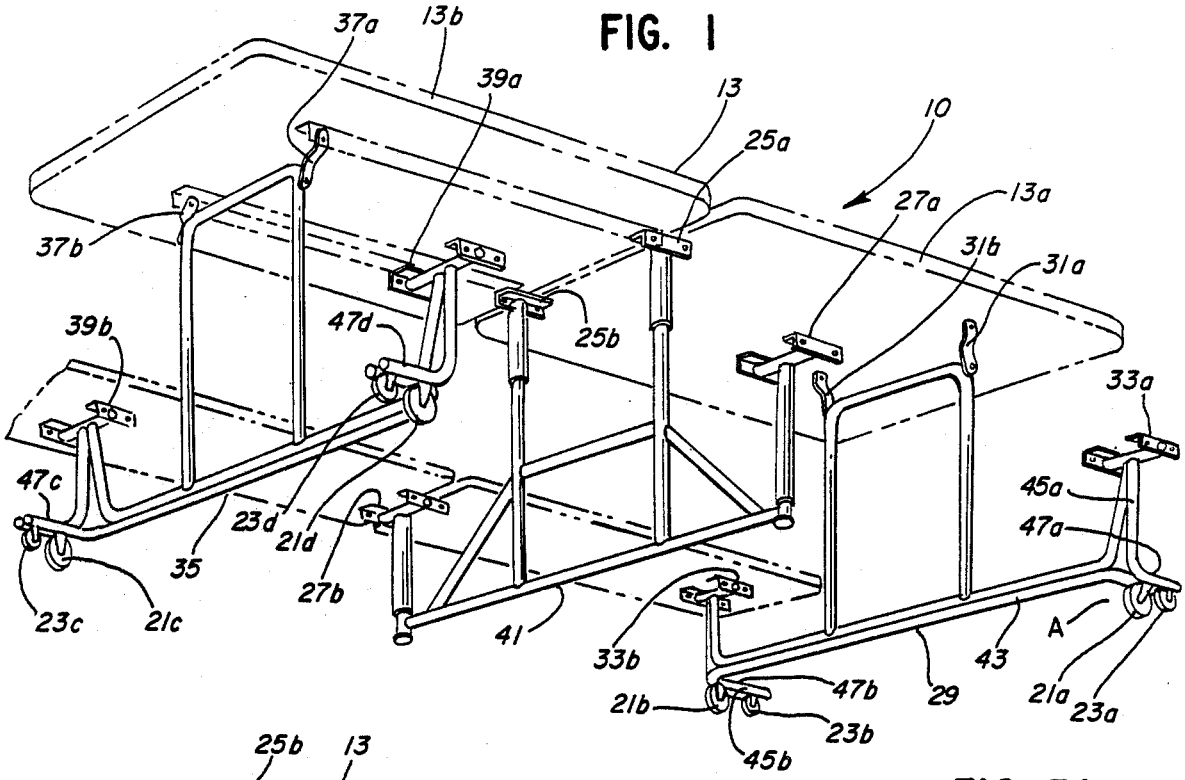
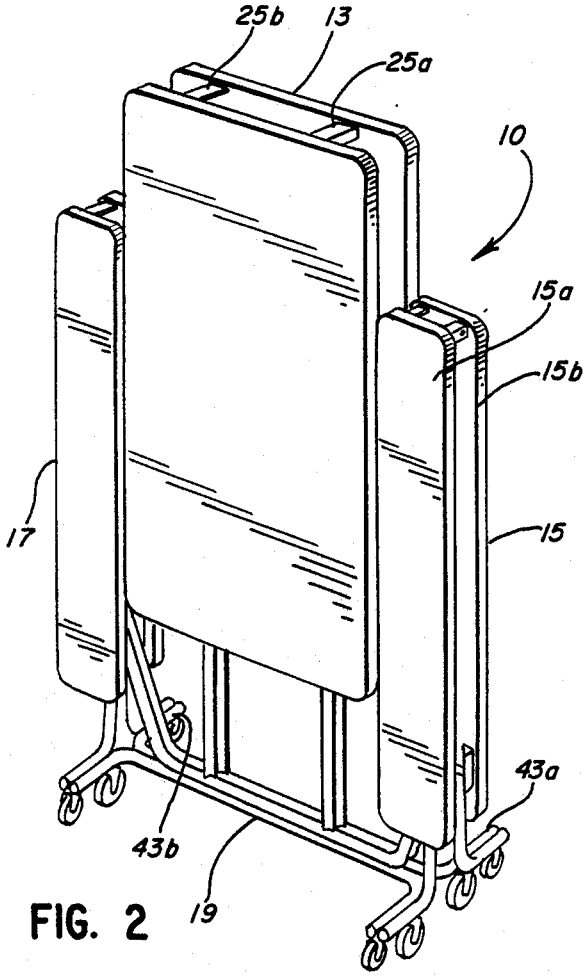
FIG. 2
FIG. 3A
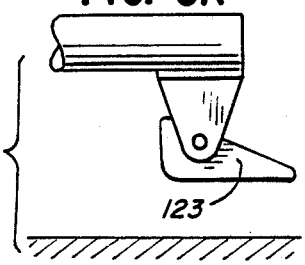
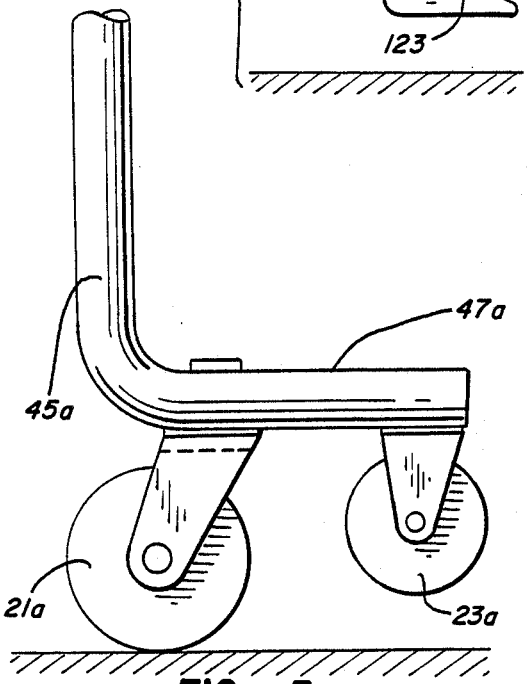
FIG. 3

MOVABLE TABLE WITH STABILIZING APPARATUS

BACKGROUND OF THE INVENTION

1. Field Of The Invention

The present invention relates to a movable and foldable table which rides on casters and which assumes a closed and an open configuration. More particularly, the present invention relates to a movable and foldable table with auxiliary casters, rollers or slides which stabilize the table when it begins to tip over after a user places it in the closed position.

2. Description Of The Prior Art

A folding table assembly of the type disclosed in Anderson et al. U.S. Pat. No. 3,191,991 includes a table top, two bench seats, a leg support pivotally connected to the table top and the bench seats, and two pairs of casters, each pair mounted to the leg support at opposite, longitudinal ends of the support. The leg support allows the user to place the assembly in either an open or a closed configuration and to maintain the assembly in those positions.

In the closed position, the assembly has a slender, upright configuration with the casters disposed proximate to the structure and below it. In this position, the assembly has a length substantially smaller than its length in the open configuration; and the distance between corresponding casters at opposite, longitudinal ends of the table is substantially smaller in the closed configuration than in the open position.

Moving this prior table when it lies in the closed position presents a safety hazard. The slender and upright shape of the assembly and the close arrangement of the casters makes the structure unstable. It may tip over if a caster encounters an obstacle.

Specifically, the center of gravity of the folded structure lies proximate the vertical line which extends through the pivot point as defined by the center of the caster which has encountered an obstacle. When the caster engages the obstacle, it stops rolling, and the table begins to tip over. The center of gravity moves past the center of this caster, and the table falls over. Since many of these prior tables have a substantial length and weight, any injury resulting from their tipping over could be severe.

One solution provided in the prior art includes arranging the casters to lie a greater distance apart when the table assumes the upright configuration. However, this distance cannot exceed a maximum spacing because the table must move through doorways. In addition, an increase in the spacing between casters increases the storage space needed for the table.

The movable table of the present invention provides an auxiliary set of casters to stabilize the table. Other rollers, glides or slides may also provide the requisite stability in place of the auxiliary casters. The auxiliary casters stabilize the table when it begins tipping over. They also allow a limited, controlled rocking action when the table assumes the folded configuration, taking the weight off the main or primary casters and permitting them to easily skip over obstacles.

SUMMARY OF THE INVENTION

It is an object of this invention to provide a foldable and movable table assembly with auxiliary casters or other rollers, glides or slides which stabilize the assembly in the upright or closed position.

It is another object of the present invention to provide a movable table with a simple and sturdy construction which allows high-density storage.

It is still another object of this invention to provide a movable and foldable table which provides, in the folded configuration, a limited and controlled rocking action for warning a user when its casters encounter an obstacle, and for allowing its casters to easily roll over floor obstacles.

Other objects, advantages and features of the present invention will become apparent upon reading the following detailed description and appended claims and upon reference to the accompanying drawings.

In accordance with one embodiment of this invention, a movable table which achieves the foregoing objects includes a table top with two sections positioned in end-to-end relation to form an elongate, rectangular top surface. Preferably, it also includes two elongate bench seats disposed along opposite transverse edges of the table top. Each bench seat has two sections positioned in end-to-end relation along the sides of corresponding sections of the table top and below the table top. Alternatively, the movable table of the present invention may not include seats.

The movable table also includes a leg support assembly pivotally mounted to the bottom of the table top and the bench seats. This assembly supports the table top and the two bench seats; it allows a user to place the table in a closed and an open configuration; and it includes a middle support and two end supports disposed at opposite longitudinal ends of the table top. The end supports include segments for connecting the support assembly to casters on which the movable table rides.

The movable table includes four primary casters and four auxiliary casters mounted to the caster receiving segments of the end supports. The primary casters engage a supporting surface and allow a user of the table to move it.

The auxiliary casters lie a predetermined distance outward of corresponding primary casters and a predetermined distance above the supporting surface which the primary casters engage. They do not engage the supporting surface until the table begins to tip over. This typically occurs when one or both of the two front primary casters encounter an obstacle as the table rolls over the supporting surface in a direction normal to its folded table top panels. At this point, the two auxiliary casters proximate the two front primary casters engage the supporting surface bearing the weight of the table and allow the table to roll on them and the primary casters to roll over the obstruction. Although the preferred embodiment uses auxiliary casters to stabilize the table, rollers, slides or glides may provide the same stabilizing function.

The auxiliary casters effectively move the pivot point for the table forward, from the center of the primary casters to the center of the auxiliary casters. Thus, the center of gravity of the table remains behind the pivot point as the primary casters roll over an obstacle. The auxiliary casters stabilize the table and minimize the likelihood that it will fall over when it encounters an obstacle.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a perspective view of the preferred embodiment of the movable table of the present invention, showing the table in the open configuration.

FIG. 2 is a perspective view of the movable table, showing the table in the closed configuration.

FIG. 3 is a side elevation view of detail A in FIG. 1, showing an auxiliary caster.

FIG. 3A is a side elevation view of detail A, showing a slide in place of the auxiliary caster.

Figure 6:
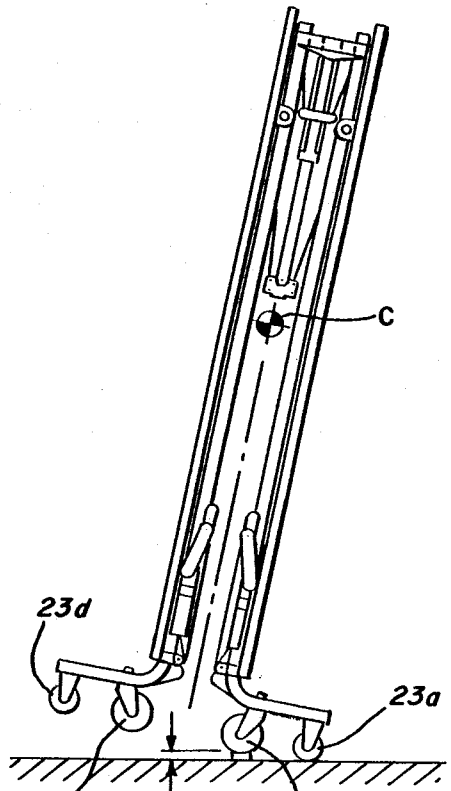
FIG. 6 is a side elevation view, similar to the one shown in FIG. 4, showing the movable table after the stabilizing auxiliary casters have engaged the supporting surface, when the primary caster begins to roll over the obstacle.

While the applicants will describe the invention in connection with a preferred embodiment, one will understand that the invention is not limited to this embodiment. Furthermore, one should understand that the drawings are not necessarily to scale. In certain instances, the applicants may have omitted details which are not necessary for an understanding of the present invention.

DETAILED DESCRIPTION OF THE DRAWINGS AND THE PREFERRED EMBODIMENT

Turning now to the drawings, FIGS. 1 and 2 show the preferred embodiment of a movable table at 10. This table 10 generally comprises an elongate table top 13; a first elongate bench seat 15 disposed along one side of the table top 13; a second elongate bench seat 17 disposed along the opposite side of the table top; a leg support assembly 19 pivotally mounted to the table top 13 and the bench seats 15 and 17; four primary casters 21*a*, 21*b*, 21*c*, and 21*d* subtending the leg support assembly and mounted to it; and four auxiliary casters 23*a*, 23*b*, 23*c*, and 23*d* also mounted to the support assembly 19.

The table top 13 includes two sections, 13, and 13*b*, positioned in end-to-end relation and joined together with hinge connectors 25*a* and 25*b*. These connectors allow folding of the two sections in face-to-face relation; and they space the sections 13*a* and 13*b* apart so that these sections may receive a portion of the supporting assembly 19 between them when the table 10 lies in the closed position shown in FIG. 2.

The bench seat 15 lies parallel to the table top 13 along one transverse side of the table top. It includes two sections 15, and 15*b* positioned in end-to-end relation. Hinge connectors 27*a* and 27*b* pivotally connect the two sections 15*a* and 15*b* together and space them apart a predetermined distance. Thus, when disposed in the closed position, these sections 15*a* and 15*b* also receive a portion of the supporting structure 19 between them.

The bench seat 17 lies parallel to the table top 13 along the transverse side opposite that of bench seat 15. It has the same components that bench seat 15 has, connected together in the same manner. Although the preferred embodiment of the movable table of the present invention includes bench seats, alternative embodiments may not.

The leg support assembly 19 supports the table top 13 and the bench seats 15 and 17; and it allows a user of the table 10 to place the table in an open position or configuration (FIG. 1) and in a closed position or configuration (FIG. 2). It includes an end member 29 disposed at one longitudinal end of the table top 13 and pivotally connected to the table top 13 with connecting arms 31*a* and 31*b* and to the bench seats 15 and 17 with hinge connectors 33*a* and 33*b*. The assembly 19 also includes an end member 35 disposed at the opposite longitudinal end of the table top 13 and pivotally connected to the table top with connecting arms 37*a* and 37*b* and to the bench seats with hinge connectors 39*a* and 39*b*. Finally, the assembly 19 includes a middle support 41 fixedly secured to the connectors 25*a*, 25*b*, 27*a* and 27*b* which pivotally mount this middle support 41 to the table top 13 and to the bench seats 15 and 17. Preferably, the support structure 19 has a metallic, tubular construction.

Anderson et al. U.S. Pat. No. 3,191,991 entitled "Table and Bench Assembly" generally discloses the leg support assembly 19 in greater detail. With this reference the applicant incorporates the disclosure of that patent to the disclosure of this application.

The end member 29 of the leg support structure 19 comprises five tubular segments welded or otherwise fixedly secured together, including a segment 43 having a U configuration and two segments 45*a* and 45*b* having an L configuration. One arm 43*a* of the segment 43 and the leg of segment 45*a* lie side-by-side and extend horizontally and longitudinally outward of the table 10 to form a cantilever segment 47*a*. The other arm 43*b* of the segment 43 and the leg of the segment 45*b* also lie side-by-side and extend horizontally and longitudinally outward of the table 10 to form a cantilever segment 47*b*. The cantilever segment 47*a* receives casters 21*a* and 23*a*; and the cantilever segment 47*b* receives casters 21*b* and 23*b*. Similarly, the end member 35 has cantilever segments 47*c* and 47*d* which receive casters 21*c* and 23*c* and 21*d* and 23*d*, respectively.

As shown in FIG. 3, the primary casters 21*a–d* lie at the inner ends of the cantilever segments 47*a–d*; and the auxiliary casters 23*a–d* lie a predetermined distance outward of the corresponding primary casters 21*a–d*, at the distal ends of the cantilever segments 47*a–d*. The auxiliary casters 23*a–d* are smaller than the primary casters 21*a–d*. Therefore, the table 10 usually rolls on the primary casters. Alternatively, the auxiliary casters may have the same size as the primary casters 21*a–d*; and the cantilever segments may lie at an angle to the horizontal to raise the auxiliary casters off the supporting surface.

The auxiliary casters 23*a–d* lie at a predetermined distance off the supporting surface. However, the table 10 rolls on them under various conditions in the manner described below.

Figure 4:
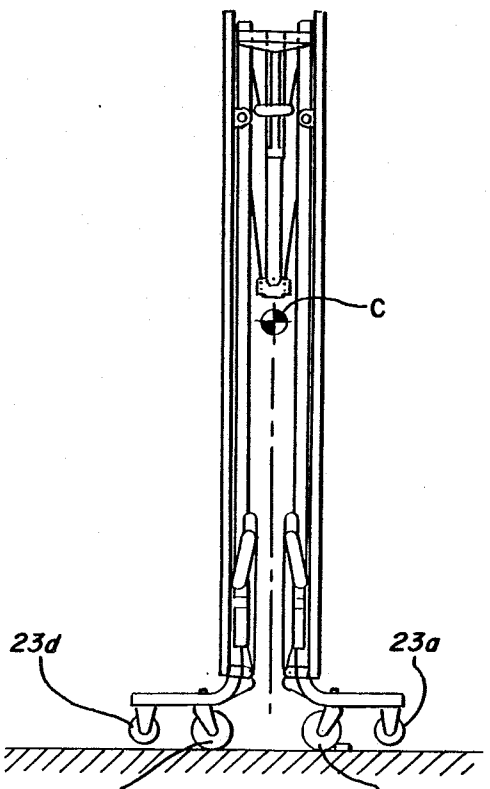
FIG. 4 is a side elevation view of the movable table in the closed, upright configuration, showing the table during its movement from left to right along a supporting surface at the instant the front primary caster engages an obstacle.

When the table has an open configuration (FIG. 1), the casters 21*a–d* and 23*a–d* lie at the corners of an elongate, imaginary rectangle. In the closed configuration (FIG. 2), the casters lie substantially closer together than they do in the open configuration. In this closed configuration, the center of gravity of the table, C, lies proximate the vertical lines which extend through the primary casters 21*a–d* as shown in FIG. 4. Without the auxiliary casters, the table 10, when its primary casters encounter an obstacle as it moves over a supporting surface, pivots on the primary casters which engage the obstacle (primary caster 21*a* and 21*b* in FIG. 4), rotates until the center of gravity moves past the pivot point (axis of the casters 21*a* and 21*b*), and falls over.

Figure 5:
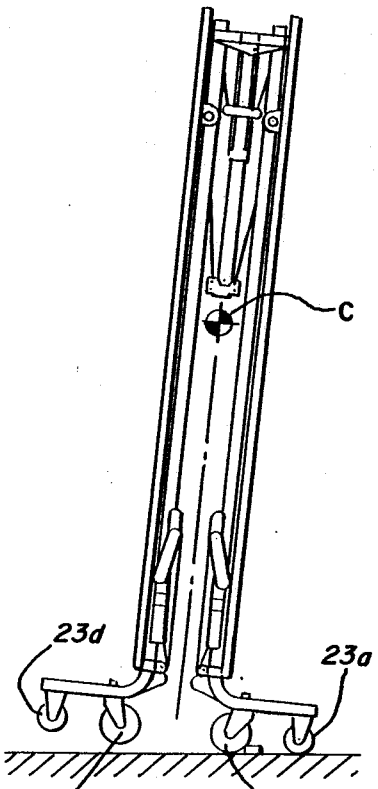
FIG. 5 is a side elevation view, similar to the one shown in FIG. 4, showing the table tipping forward in the direction of travel and the stabilizing auxiliary casters engaging the supporting surface.

The table 10 of the present invention, however, includes auxiliary casters (casters 23*a* and 23*b* in FIGS. 4–6) which pass over the obstacle and engage the supporting surface when the table 10 begins to tip over. In addition, the auxiliary casters (23*a* and 23*b* in FIGS. 4–6) allow the table to roll forward on them and the primary casters (21*a* and 21*b* in FIGS. 4–6) to skip over the obstacle (See FIGS. 5 and 6). The sound and/or movement resulting from the contact of the auxiliary casters with the supporting surface provides a warning signal to the user.

In the preferred embodiment the primary casters 21*a–d* lie pivotally mounted to the leg support assembly 19 with a swivel mount so that the casters may rotate about vertical axes. Thus, the wheels of the primary casters rotate about horizontal axes which move freely in a horizontal plane. Accordingly, a user may move the table in any desired direction and may easily change directions. Alternatively, the primary casters may have a ball-type wheel or roller which rotates freely about any axis which extends through its center.

In the preferred embodiment, the auxiliary casters 23*a–d* lie fixedly secured to the leg support assembly 19; and they include wheels which rotate about axes disposed transversely of the table 10. Consequently, they roll without interruption when a user moves the table in a direction normal to the folded table top panels 13*a* and 13*b* and when the table begins to tip over. Alternatively, the table 10 may include auxiliary casters, pivotally mounted to the leg support assembly with conventional swivel connections and/or having ball-type wheels or rollers. These casters could roll smoothly in any direction. Furthermore, any conventional glide, slide or roller arrangement may provide the function provided by the auxiliary casters of the preferred embodiment. (See slide 123 in FIG. 3A).

The auxiliary casters 23*a–d* do not engage the supporting surface until the table begins to tip over. This typically occurs when one or both of the front primary casters encounter an obstacle as the table rolls over the supporting surface in a direction normal to the folded table top panels. When this occurs, the two auxiliary casters proximate the two front primary casters engage the supporting surface and allow the table to roll on them and the primary casters to skip over the obstruction. Thus, the table 10 provides a limited and controlled rocking action which allows the table to safely roll over floor obstacles.

The auxiliary casters effectively move the pivot point of the table forward, from the center of the primary casters to the center of the auxiliary casters. Therefore, the center of gravity of the table remains behind the pivot point as the primary casters roll over an obstacle; and the table does not fall over when it tips forward.

Embodiments with substantially reduced table widths, i.e., embodiments in which the primary casters define a substantially square pattern, present a danger of tipping in a direction parallel to the table top panels as well as in the normal direction. In these alternatives, the table of the present invention may include cantilever segments projecting transversely outward of the table as well as the longitudinally projecting segments of the preferred embodiment. These transverse segments also receive auxiliary casters.

Thus, the applicants have provided a movable table with an auxiliary set of casters which stabilize the table when it begins to tip over. In addition, these auxiliary casters allow the primary casters to easily skip over obstacles. While the applicants have shown only one embodiment of the invention, one will understand, of course, that the invention is not limited to this embodiment since those skilled in the art to which the invention pertains may make modifications and other embodiments of the principles of this invention, particularly upon considering the foregoing teachings. The applicants, therefore, by the appended claims, intend to cover any such modifications and other embodiments as incorporate those features which constitute the essential features of this invention.

What is claimed is:

1. A movable table assembly operable between open and closed positions, said assembly comprising: a table top; a rigid leg support assembly subtending said table top and pivotally mounted to said table top, said leg support assembly supporting said table top in an open generally horizontal position and in a closed generally vertical position; primary caster means for engaging and rolling on a supporting surface when said table top is disposed in a closed generally vertical position, said primary caster means subtending said leg support assembly and mounted to said support assembly; and auxiliary caster means for engaging said supporting surface when said table top is disposed in a closed generally vertical position and said table being to tip over to stabilize said table, said auxiliary caster means mounted to said leg support assembly and disposed a predetermined distance above said supporting surface when said table lies in an upright position and a predetermined distance away from said primary caster means.

2. A movable table as in claim 1, wherein said leg support assembly includes a plurality of caster support segments to which said primary and auxiliary caster means are mounted.

3. A movable table as in claim 1, wherein said primary caster means is a caster with a roller of a first predetermined diameter and said auxiliary caster means is a caster with a roller of a second, smaller predetermined diameter.

4. A movable table as in claim 1, wherein said leg support assembly includes a first member pivotally connected to a first end of said table and a second member pivotally connected to a second, opposite end of said table, each of said members having two cantilever segments spaced a predetermined distance, said cantilever segments projecting horizontally outward of said support assembly.

5. An improved, movable table operable between open and closed positions and having a table top, a rigid leg support assembly subtending said table top, pivotally mounted to said table top, and supporting said table top in a closed generally vertical position and in an open generally horizontal position, primary caster means for engaging a supporting surface when said table top is disposed in a generally vertical position, said primary caster means subtending said leg support assembly and mounted to said leg support assembly, wherein the improvement comprises: second means mounted to said leg support assembly for engaging said supporting surface when said table top is disposed in a closed generally vertical position and when the table begins to tip over to stabilize said table, said second means disposed a predetermined distance above said supporting surface when the table lies in an upright position and a predetermined distance from said primary caster means.

* * * * *

UNITED STATES PATENT AND TRADEMARK OFFICE

CERTIFICATE OF CORRECTION

PATENT NO. : 4,819,569

DATED : April 11, 1989

INVENTOR(S) : Bastian, John M.; Pflieger, David C.; Seitz, Robert F.

It is certified that error appears in the above-identified patent and that said Letters Patent is hereby corrected as shown below:

Column 3, line 52, cancel "13," and substitute "13a"
Column 3, line 62, cancel "15," and substitute "15a"
Column 6, line 36, cancel "being" and substitute "begins".

On the title page, under item [56]-
Insert the following under "U.S. PATENT DOCUMENTS":

| | | | |
|---|---|---|---|
| 2,766,089 | 10/1956 | Nielsen . . . . . | 108/113 |
| 2,893,474 | 7/1959 | Bobbish . . . . . | 297/159 |
| 3,025,120 | 3/1962 | Howe . . . . . | 108/112 |
| 3,080,833 | 3/1963 | Risdall . . . . . | 108/112 |
| 3,191,991 | 6/1965 | Anderson et al. . . . | 297/159 |
| 3,245,363 | 4/1966 | Amthor, Jr. et al.. . | 108/113 |
| 4,026,221 | 3/1977 | Wilson et al. . . . . | 108/113 |
| 4,067,266 | 1/1978 | Lafargue . . . . . | 108/112 |

UNITED STATES PATENT AND TRADEMARK OFFICE

CERTIFICATE OF CORRECTION

PATENT NO. : 4,819,569

DATED : April 11, 1989

INVENTOR(S) : Bastian, John M.; Pflieger, David C.; Seitz, Robert F.

It is certified that error appears in the above-identified patent and that said Letters Patent is hereby corrected as shown below:

On the title page, after the references cited under "[56] U.S. PATENT DOCUMENTS" insert the following:

OTHER PUBLICATIONS:

Drawing D-13F902, Hamilton Industries, Inc.
Drawing D-13F908, Hamilton Industries, Inc.

Signed and Sealed this

Twentieth Day of March, 1990

*Attest:*

*Attesting Officer*

JEFFREY M. SAMUELS

*Acting Commissioner of Patents and Trademarks*

REEXAMINATION CERTIFICATE (1345th)

United States Patent [19]

Bastian et al.

[11] B1 4,819,569

[45] Certificate Issued Aug. 28, 1990

[54] MOVABLE TABLE WITH STABILIZING APPARATUS

[75] Inventors: John M. Bastian, Manitowoc; David C. Pflieger, Two Rivers; Robert F. Seitz, Manitowoc, all of Wis.

[73] Assignee: Hamilton Industries, Inc.

Reexamination Request:
No. 90/001,904, Dec. 7, 1989

Reexamination Certificate for:

| | |
|---|---|
| Patent No.: | **4,819,569** |
| Issued: | **Apr. 11, 1989** |
| Appl. No.: | **158,204** |
| Filed: | **Feb. 19, 1988** |

[51] Int. Cl.[5] ..... A47B 3/00

[52] U.S. Cl. ..... 108/113; 16/18 B; 280/47.2

[56] References Cited

U.S. PATENT DOCUMENTS

| | | | |
|---|---|---|---|
| 1,080,578 | 12/1913 | Peppe | 280/47.2 |
| 1,217,047 | 2/1917 | Morris | 280/47.2 |
| 3,191,991 | 6/1965 | Anderson et al. | 297/159 |
| 3,451,361 | 6/1969 | Sorenson | 108/50 |
| 4,205,937 | 6/1980 | Fawley | 280/47.2 |

*Primary Examiner*—Peter A. Aschenbrenner

[57] ABSTRACT

A movable table is provided which includes a table top; two bench seats; a leg support assembly pivotally connected to the table top and the bench seats; four primary casters disposed below the leg support assembly and mounted to the assembly; and four auxiliary casters. The leg support assembly supports the table top and bench seats in an open and in a closed configuration; and it allows a user to place the table in these two positions. The auxiliary casters stabilize the table in the closed position when it begins to tip over. In addition, these auxiliary casters allow the primary casters to easily skip over obstacles.

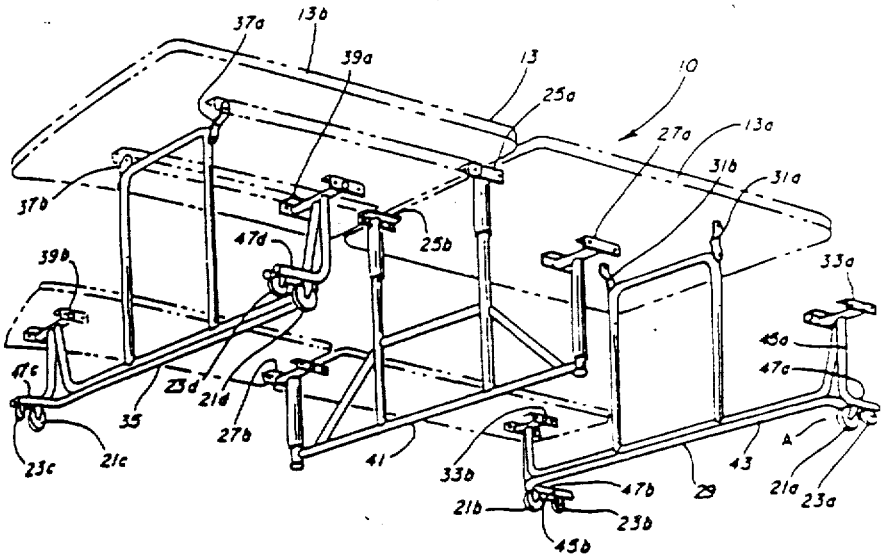

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *